US007870700B2

(12) United States Patent
Arguelles

(10) Patent No.: US 7,870,700 B2
(45) Date of Patent: Jan. 18, 2011

(54) PAN TILE FOR ROOFING SYSTEM

(76) Inventor: Daniel Efrain Arguelles, 9455 S.W. 78th St., Miami, FL (US) 33173

( * ) Notice: Subject to any disclaimer, the term of this patent is extended or adjusted under 35 U.S.C. 154(b) by 709 days.

(21) Appl. No.: 11/788,987

(22) Filed: Apr. 23, 2007

(65) Prior Publication Data

US 2007/0289243 A1 Dec. 20, 2007

Related U.S. Application Data

(63) Continuation-in-part of application No. 11/455,346, filed on Jun. 19, 2006, now Pat. No. 7,513,084.

(51) Int. Cl.
*E04D 1/28* (2006.01)

(52) U.S. Cl. ..... 52/519; 52/469; 52/553

(58) Field of Classification Search ..... 52/516, 52/518, 519, 469, 473, 553, 554; D25/140
See application file for complete search history.

(56) References Cited

U.S. PATENT DOCUMENTS

| | | | | | |
|---|---|---|---|---|---|
| 511,859 | A | * | 1/1894 | Montross | 52/461 |
| 544,770 | A | | 8/1895 | Plympton | |
| 553,321 | A | * | 1/1896 | Taylor | 52/542 |
| 880,012 | A | * | 2/1908 | Christensen | 52/536 |
| 1,155,559 | A | * | 10/1915 | Franklin | 52/533 |
| 1,251,950 | A | * | 1/1918 | Ames et al. | 52/478 |
| 1,826,082 | A | | 10/1931 | Mastick | |
| 1,967,764 | A | * | 7/1934 | Brown | 52/521 |
| 2,035,921 | A | * | 3/1936 | Quinn | 428/146 |
| 2,039,536 | A | * | 5/1936 | Johnson | 52/314 |
| 2,100,505 | A | * | 11/1937 | Harold | 52/277 |
| 2,160,548 | A | | 5/1939 | Kawamura | |
| 2,250,482 | A | * | 7/1941 | Harshberger | 428/168 |
| 2,984,945 | A | | 5/1961 | Campbell | |
| 3,760,546 | A | | 9/1973 | Martin et al. | |
| 3,848,383 | A | * | 11/1974 | Wilson et al. | 52/533 |
| 3,899,855 | A | | 8/1975 | Gadsby | |
| 4,028,450 | A | | 6/1977 | Gould | |
| 4,544,595 | A | | 10/1985 | Tomason | |
| 4,716,701 | A | | 1/1988 | Talbot | |
| 4,932,184 | A | | 6/1990 | Waller | |
| 5,215,805 | A | | 6/1993 | Pavia, Jr. | |

(Continued)

FOREIGN PATENT DOCUMENTS

WO WO 2007/149369 A1 12/2007

*Primary Examiner*—Robert J Canfield
*Assistant Examiner*—Christine T Cajilig
(74) *Attorney, Agent, or Firm*—Malloy & Malloy, P.A.

(57) ABSTRACT

A pan tile for use in a roofing system, wherein a plurality of such pan tiles are disposed in confronting, supported relation on an underlying roof support and in underlying, at least partially supporting relation to plurality of overlapping, exteriorly exposed roof tiles, wherein the pan tiles may be structured individually or integrally in longitudinal arrays. The pan tile includes a planar base and two oppositely disposed planar side segments extending outwardly from opposite peripheries of said base at a common, preferred obtuse angle. Leading and trailing ends of pan tiles have a greater and lesser transverse dimension respectively, wherein the side segments or oriented in a converging configuration extending from the leading end to the trailing end of the pan tile. Solar energy systems may also be incorporated in the individual pan tiles and/or the longitudinal arrays thereof.

24 Claims, 8 Drawing Sheets

U.S. PATENT DOCUMENTS

| | | | | |
|---|---|---|---|---|
| 5,392,584 | A | 2/1995 | Perez-Wilson | |
| 5,465,547 | A | 11/1995 | Jakel | |
| 5,651,226 | A | 7/1997 | Archibald | |
| 5,768,831 | A | 6/1998 | Melchior | |
| 5,837,363 | A | 11/1998 | Colafati | |
| 6,125,602 | A | 10/2000 | Freiborg et al. | |
| 6,708,463 | B2 * | 3/2004 | Chai | 52/748.1 |
| 6,920,730 | B2 | 7/2005 | Becker et al. | |
| 2005/0102947 | A1 * | 5/2005 | McCaskill et al. | 52/518 |
| 2007/0022692 | A1 | 2/2007 | Friedman et al. | |
| 2007/0289242 | A1 | 12/2007 | Arguellas | |

* cited by examiner

PAN TILE FOR ROOFING SYSTEM

CLAIM OF PRIORITY

The present application is a continuation-in-part application of previously filed, application having Ser. No. 11/455,346, filed on Jun. 19, 2006, incorporated herein by reference and which has matured into U.S. Pat. No. 7,513,084 on Apr. 7, 2009.

BACKGROUND OF THE INVENTION

1. Field of the Invention

The present invention is directed to a pan tile for use in a roofing system wherein a plurality of pan tiles cover an underlying, supporting roof structure and are collectively oriented to support a plurality of exterior, exposed roof tiles thereon. Each pan tile includes a substantially planar base and oppositely disposed planar side segments cooperatively dimensioned, configured and structured to require a lesser number of both the exposed roof tiles and pan tiles being used to cover a given surface area of the underlying roof structure.

2. Description of the Related Art

In modern day construction, roof covering systems typically include an underlying, supporting deck or like support structure. This underlying support structure is covered by a water proof or leak resistant material that may take various forms. In addition, roofing tiles, shingles and like roof coverings are frequently arranged and secured in overlapping relation to one another so as to collectively overlie the roof deck or like underlying roof support structure. Further, the water resistant covering applied to the outer surface of the roof deck serves to secure the plurality of exterior roof tiles directly to the underlying support. Alternatively, other materials such as cement, polyurethane, "poly-foam", etc. may be utilized to secure or fix an underlying layer of roof tiles, shingles, etc. directly to the outer water resistant layer. As such, a roofing system, as generally described above, facilitates a water resistant roofing assembly as well as an outer or exterior, aesthetically pleasing roof covering.

However, one constant and continuous area of concern is the structure and procedure utilized in the installation of a roofing system specifically including the roofing tiles or like roof covering materials. In typical fashion, roof tiles may include an underlying tile disposed in laterally adjacent relation to one another and arranged in longitudinally adjacent rows or columns, especially when the roofing system is applied to a slanted or sloped roof. Moreover, an outer array of roof tiles are disposed in overlapping, at least partially supported relation on the underlying tiles. As such, the underlying tiles and outer roof tiles make up the exposed covering of the roof deck or like underlying roofing support structure.

In known or conventional roofing systems of the type generally described above, it is recognized in the roofing industry that both time and labor associated with installation, as well as the material cost of both underlying tiles and outer, exposed roof tiles are significant and sometimes prohibitive. These costs are especially high when both the underlying tiles and roof tiles are formed of a highly desirable but relatively expensive ceramic material, which are typically hand made or otherwise manufactured to meet customized specifications.

Accordingly, there is a long recognized need in the roofing industry for a roofing system incorporating roofing materials which reduce the cost and time of installation, as well as reduce the cost of materials a frequently large number of roofing tiles. Such a proposed roofing system should incorporate a pan tile which is dimensioned, configured and structured so as to adequately and effectively cover the underlying roofing support structure while at the same time effectively support the exterior, overlying roof tiles. Moreover, a preferred pan tile could be machine made either from a ceramic or other appropriate material and dimensioned and configured to provide adequate support to the overlying roof tiles. At the same time such a newly proposed pan tile would require a significantly lesser number of both the pan tiles and the conventional roof tiles overlying the improved pan tiles.

Further, the versatility of the proposed pan tile could be such as to serve as an underlying support for a variety of different outer roof tiles specifically including, but not limited to, barrel tiles of the type which are commonly used on domestic dwellings, condominiums and industrial buildings of various styles and designs. Moreover, a roofing system incorporating the preferred and proposed pan tiles of the type described above, should be capable of being secured in overlying relation to the underlying support structure of the roof using any conventional manner including the use of roof installation connectors such as nails, screws, etc or even the more complex connecting wires, clips, or like connectors which facilitate adherence of roofing tiles during extremely high wind conditions. However, when a securing material such as cement, poly-foam, etc. is utilized with a roofing system incorporating a proposed and improved pan tile a significantly lesser amount of such material should be required thereby further increasing the savings in material costs.

SUMMARY OF THE INVENTION

The present invention is directed to a roofing system and more specifically to the structure of a pan tile, wherein a plurality of such pan tiles are dimensioned, configured and structured to be incorporated in a preferred roofing system. In use, a collection of pan tiles cover and confront a roof deck or underlying support structure of a roof and provide efficient support for exterior roof tiles. Moreover, each of the plurality of pan tiles may be produced by a machine and formed from ceramic or in certain preferred embodiments of the present invention, from a fiber glass or other type of appropriate material. The forming of the pan tiles from a fiber glass or other appropriate material has the benefit of a significant reduction in weight while not sacrificing strength or other desirable physical characteristics. The reduction in weight when using a fiber glass pan tile also results in less cost of installation at least to the extent of those costs associated with the transporting of the assemblage of roof tiles to the work site as well as the physically lifting of tiles onto the roof area. While the formation of the pan tiles from fiber glass based material may comprise one preferred embodiment, additional preferred embodiments comprise the inclusion of various types of organic material into the composition of the tile. Moreover, such organic material may be used in combination with appropriate resins such that an organic/resin combination material from which the pan tile is formed facilitates molding of the tile into the desired dimension and configuration.

The structuring of the pan tiles and their collective disposition over the underlying roof support is such as to effectively confront, overlie and protect the underlying support of the roof. At the same time a significantly lesser number of roof tiles are required in providing an aesthetically pleasing exterior, exposed roof covering. Accordingly the present invention is directed to a roofing system which may be produced and installed in a manner which accomplishes a reduction in the cost of material and labor when utilized.

More specifically, each of the pan tiles includes an elongated, substantially planar base, which may vary in dimension, dependent on the particular application of the roofing system with which the preferred pan tiles are utilized. Further, the base of each pan tile comprises oppositely disposed, spaced apart side segments extending angularly outward from the base. Each side segment extends along a different longitudinal periphery of the base and preferably includes a substantially planar shape or configuration. In a most preferred embodiment of the present invention, the side segments extend outwardly at a common, obtuse angle relative to the base. Therefore, the transverse dimension of the base at least partially defines the spacing between the side segments so as to facilitate efficient support of the exterior roof tiles. Accordingly, a greater than normal spacing is provided between the laterally adjacent roof tiles of the roofing system, resulting in less roof tiles being used.

Additional structural features of one or more preferred embodiments of the pan tile include the base preferably having a common transverse dimension along its length. However, the transverse dimensions of the opposite side segments are greater at a leading end of the pan tile and converge, substantially evenly, towards a trailing end of the pan tile. This structuring results in the leading end of the pan tile having an overall greater transverse dimension than the trailing end thereof, while the oppositely disposed side segments collectively comprise a converging configuration as they extend from the leading end to the trailing end of the pan tile.

In addition, in order to provide a preferred and/or predetermined collective array of the exterior, exposed roof tiles, typically in overlapping relation to one another, the leading end of the pan tile has a greater height dimension than the trailing end thereof. Such cooperative dimensioning and configuring of the various components of the pan tile facilitate longitudinally adjacent roof tiles being efficiently arranged in an overlapping relation to one another, as is common with roofing tiles having a barrel-type configuration, as well as other types and styles of pan tiles. Similarly, longitudinally adjacent roof tiles are arranged in rows or columns which are laterally spaced from one another such that the entire underlying support of the roofing structure is covered by the combination of pan tiles and roof tiles.

Accordingly, at least one distinct advantage provided by the unique structuring of the pan tile of the present invention is the ability to utilize a lesser number of the roof tiles, regardless of their style or shape by increasing the lateral spacing between the various rows or columns of longitudinally adjacent overlapping roof tiles. By way of example, in a typical installation of the roofing system of the present invention, a one hundred sq/ft surface area of a roof deck or like underlying roof support structure may typically include approximately 70 pan tiles, disposed in confronting relation with the outer surface of the underlying roof deck and approximately 60 exterior roof tiles disposed in overlying, supported relation on the pan tiles. In comparison, conventional roofing systems of the type incorporating barrel shaped underlying pan tiles and barrel shaped exposed roof tiles would require approximately 80 pan tiles and 80 exterior roof tiles. Therefore, utilizing the roofing system of the present invention would result in savings in material cost as well as installation time and labor through the elimination of approximately 10 pan tiles and 20 of the possibly more expensive exterior roof tiles, over a commonly sized surface area, if a conventional roofing system were utilized. It should be further noted that in known or conventional roofing systems both the pan tiles as well as the roof tiles are frequently hand made or otherwise customized. Proportional savings in the underlying securing material such as polyurethane, cement, poly-foam etc. would also add to the overall savings and efficiency of utilizing a roofing system which incorporated a plurality of pan tile dimensioned, configured and structured in accordance with one or more of the preferred embodiments of the present invention.

The present invention comprises yet another preferred embodiment wherein each or at least the majority of the pan tiles, are formed of a "plastic material". As used herein, the referred to plastic material is capable of forming the pan tiles utilizing conventional or customized molding procedures. In addition, yet another preferred embodiment of the present invention comprises a fixed or preferably integral formation of a plurality of the pan tiles in an elongated, overlapping array. More specifically, the longitudinal array may be at least partially defined by the plurality of fixedly interconnected pan tiles having the trailing end of one pan tile overlapping or overlying the leading end of a next, longitudinally adjacent pan tile in the elongated array. Accordingly, the overlapping array, is described as being part of a roofing system wherein the overlapping array extends from the roof crest downwardly, such as when applied to a slanted roof structure. When practically applied in this manner, the aforementioned overlapping, longitudinal array of fixedly interconnected pan tiles have the aforementioned relative dispositions of the trailing end of at least each intermediate pan tile overlying the leading end of the next pan tile.

Similar to the preferred embodiment described above, the overall structural features of each of these pan tiles may be substantially equivalent to the extent of including an elongated base having a common transverse dimension and being integrally secured to two side segments along the opposite longitudinal peripheries of the base. Further, each of the side segments extend angularly outward from the corresponding periphery of the base at an obtuse angle. As with the additional preferred embodiments described above, the leading end of each of the pan tiles includes a greater height and transverse dimension than the trailing end thereof. Also, the side segments are collectively disposed in an at least partially converging orientation as they extend from the leading end towards the trailing end.

Moreover, in a most preferred embodiment the pan tiles further comprise predetermined surface treatments and/or structures associated with at least an undersurface of the base and possibly an inner surface of the base as well as one or both of the side segments. More specifically, the undersurface of the base preferably comprises a roughened, irregular surface configuration, which may be more specifically defined by a substantially unfinished undersurface comprising an exposure of the fiber particles or content, such as when the pan tiles are formed from fiber glass or other appropriate "moldable" materials, which may also be accurately described as being at least partially fibrous or particulate, as set forth herein.

In contrast, the surface treatment of the inner surface of the base has a predetermined, irregular surface configuration which may be more specifically defined by a particulate material being applied to or formed in the base. As such, the particulate material is disposed of various particles extending outwardly from the inner surface of the base, thereby defining the aforementioned irregular surface configuration. As will be described in greater detail hereinafter, the particulate material may be in the form of gravel, sand, rock or stone particles, etc. Also, the particulate material may have a much smaller dimensional structure or configuration such as having a granular consistency as is common with smaller, sand particles or the like.

As set forth above, a most preferred embodiment of the present invention includes at least most of the plurality of pan tiles of an applied roofing system being formed of a plastic material having structural and operative characteristics which allow the material to be molded. Such plastic material may be in the form of a polymer or like composite material, which may be even more specifically defined as a fiber reinforced polymer. Further, the plastic material from which at least the majority of the pan tiles may be formed may be a glass reinforced plastic, commonly known as "fiber glass" in popular usage.

Yet additional one or more preferred embodiments of the present invention include the provision of a solar energy system incorporated in the one or more pan tiles and/or structural modifications thereof. More specifically, the solar energy system may comprise photovoltaic systems or assemblies structured to convert, at least in terms of a roof covering, sunlight into electricity. Applicable photovoltaic systems are typically made of a semi-conductive material such as silicon. As such, cells of photovoltaic material are put together to form a module and such formulated modules can be grouped together on roofs to form arrays which generate power to the corresponding building.

Generally, there are primarily two types of photovoltaic systems comprising a crystalline (mono and poly) system and an amorphous system. The crystalline system comprises an array of silicon wafers sandwiched between two layers of glass. These panels or other structures are heavy and must be attached to a roof using secure fastening or attachment assemblies including metal brackets, bracing, etc. In contrast the amorphous silicon photovoltaic systems are flexible and light weight and may be used with various roofing components and materials in the form of a thin film. As such, the amorphous silicon photovoltaic systems can be incorporated as a laminate into the various roofing components and are almost unnoticeable when viewing the roof. Both of the above noted types of photovoltaic technologies are generally equal in cost in terms of dollars per installed watt of power. However, more financial incentives are being offered by state authorities for the use of photovoltaic technologies. In addition, the energy policy act of 2005 provides a credit of generally about 30% of expenditures for the purchase of qualified of photovoltaic equipment generally up to a range of approximately $2,000.

Therefore, one or more preferred embodiments of the present invention may include a solar energy system comprising appropriate photovoltaic assemblies incorporated into the pan tile structures. This will result in the production of solar generated energy as an extremely advantageous feature of the present invention. By way of example, various predetermined surfaces of the pan tile may be covered by a thin, flexible film or laminate of the amorphous silicon photovoltaic components. Yet another example may comprise a structural combination of the crystalline photovoltaic technology into various parts of the pan tile of the present invention.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
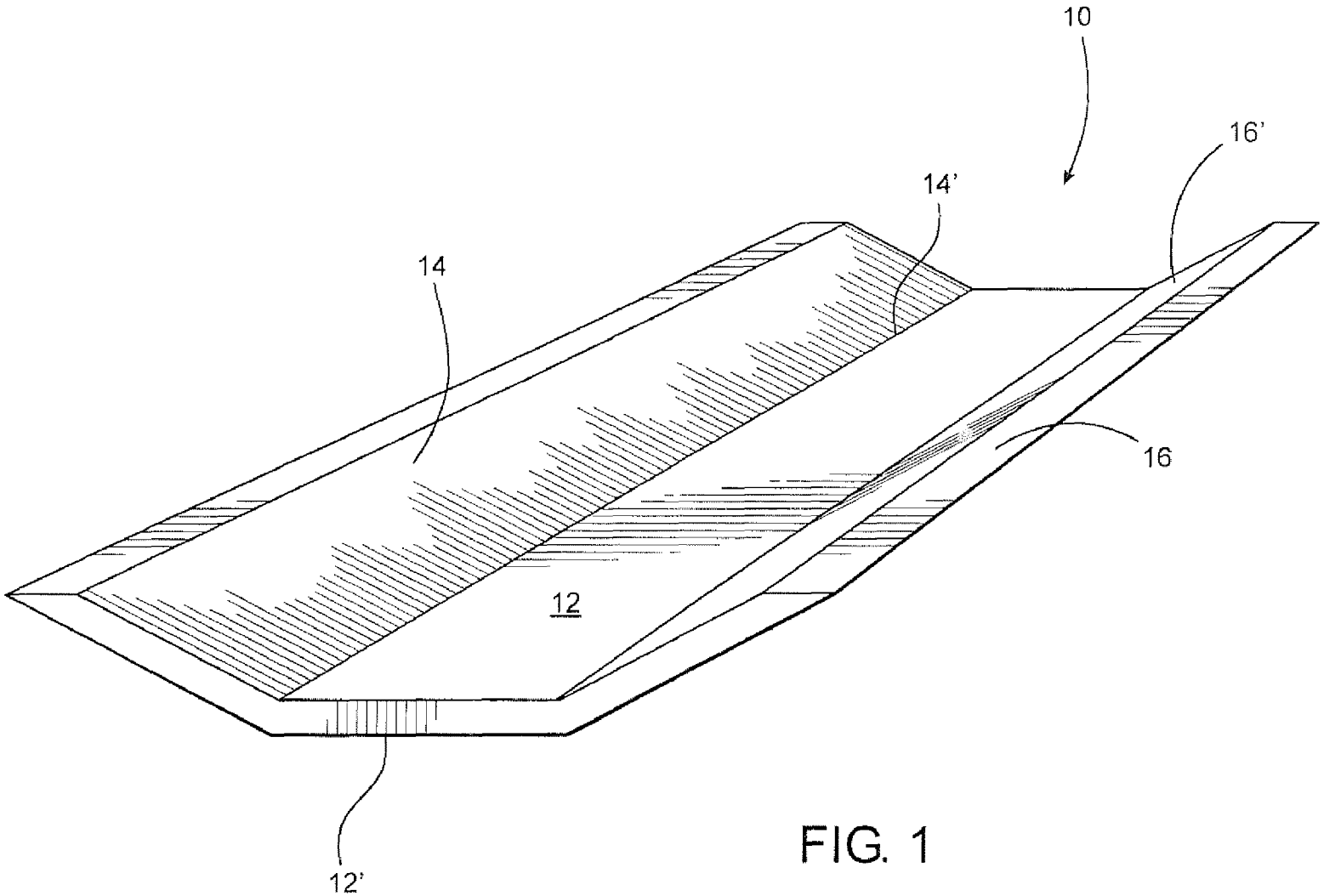
FIG. 1 is a perspective view of one preferred embodiment of a pan tile of the present invention.

The present invention is directed to a pan tile, generally indicated as 10, of the type intended to be used on roofing installations, as well as a roofing system which incorporates a plurality of such pan tiles. As dimensioned, configured and structured the pan tile 10 of the various preferred embodiments of the present invention facilitates the installation of a preferred roofing system and in addition significantly reduces the cost factor of the materials utilized. Therefore the pan tile 10 and roofing system of the present invention overcomes many of the disadvantages and problems associated with known or conventional roofing systems and materials associated therewith.

More specifically, the pan tile 10 of the present invention may be produced or manufactured by a machine, rather than by hand, and may be formed of a ceramic material or other appropriate material which facilitates a reduction in the cost of the plurality of pan tiles utilized. As set forth in greater detail hereinafter, one additional preferred embodiment of the present invention comprises the pan tile being formed of a fiber glass material or other appropriate "moldable" materials including organic materials and/or organic/resin combination materials. Each of these appropriate materials may or may not include preferred surface treatments on predetermined surfaces thereof. Further, the plurality of pan tiles 10 incorporated in a roofing system are structured to facilitate a direct confronting relation with a roof deck 20 or like underlying support and an adhering composition associated therewith. Moreover, the plurality of pan tiles 10 are adaptive for use with a variety of different styles and types of roof tiles such as, but not limited to, barrel tiles 18 which in typical fashion are disposed in overlying relation to the underlying pan tiles. An additional advantage in the utilization of the pan tile 10, based in part on their dimension, configuration and overall structure, is the reduction in the number of the exterior roof tiles 18 which are required for use over a given surface area of the underlying roofing surface 20 being covered.

More specifically, and as represented in the accompanying Figures, at least one preferred embodiment of the pan tile of the present invention is generally indicated as 10 and comprises a base 12 having an elongated configuration and being integrally secured to two side segments 14 and 16. Each of the side segments 14 and 16 preferably extend along the entire length of the base 12 and extend outwardly from opposite peripheral sides or edges 14' and 16' of the base 12 in a predetermined angular orientation. Further, each of the side segments 14 and 16 extend outwardly from the base 12 at a substantially common, obtuse angle so as to facilitate cooperative positioning and support of spaced apart, laterally adjacent roof tiles 18 as clearly represented in FIG. 7, as will be explained in greater detail hereinafter.

Figure 4:
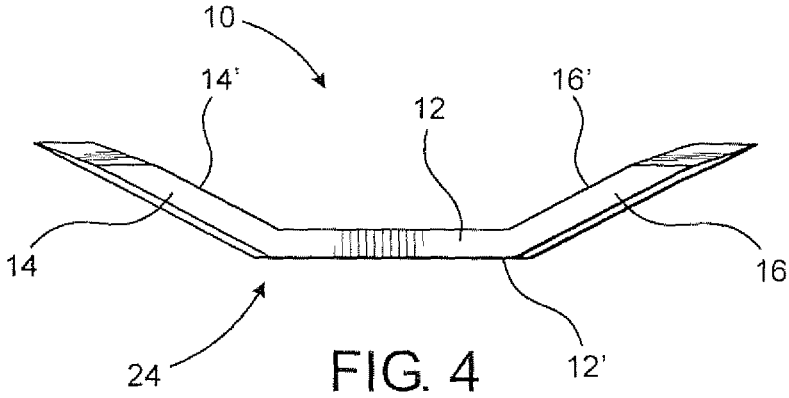
FIG. 4 is an end perspective view of the embodiment of FIGS. 1 and 3.
Figure 5:
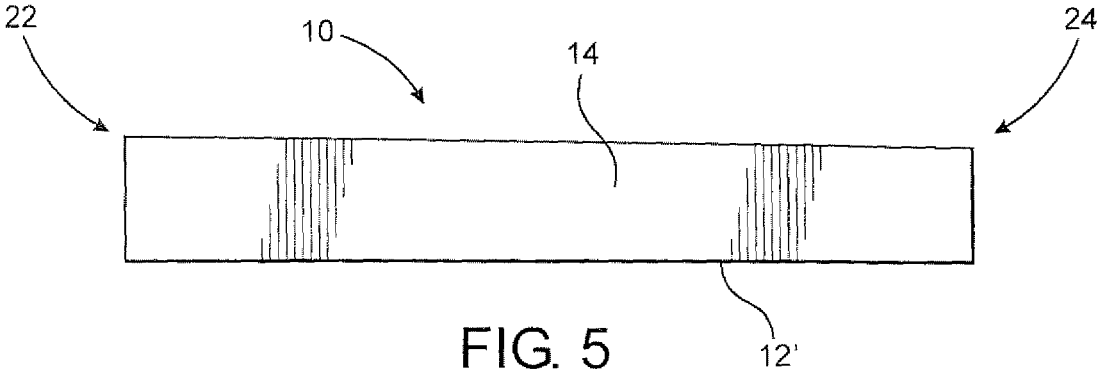
FIG. 5 is a side view of the preferred embodiment of the pan tile as represented in FIGS. 1 and 3.
Figure 6:
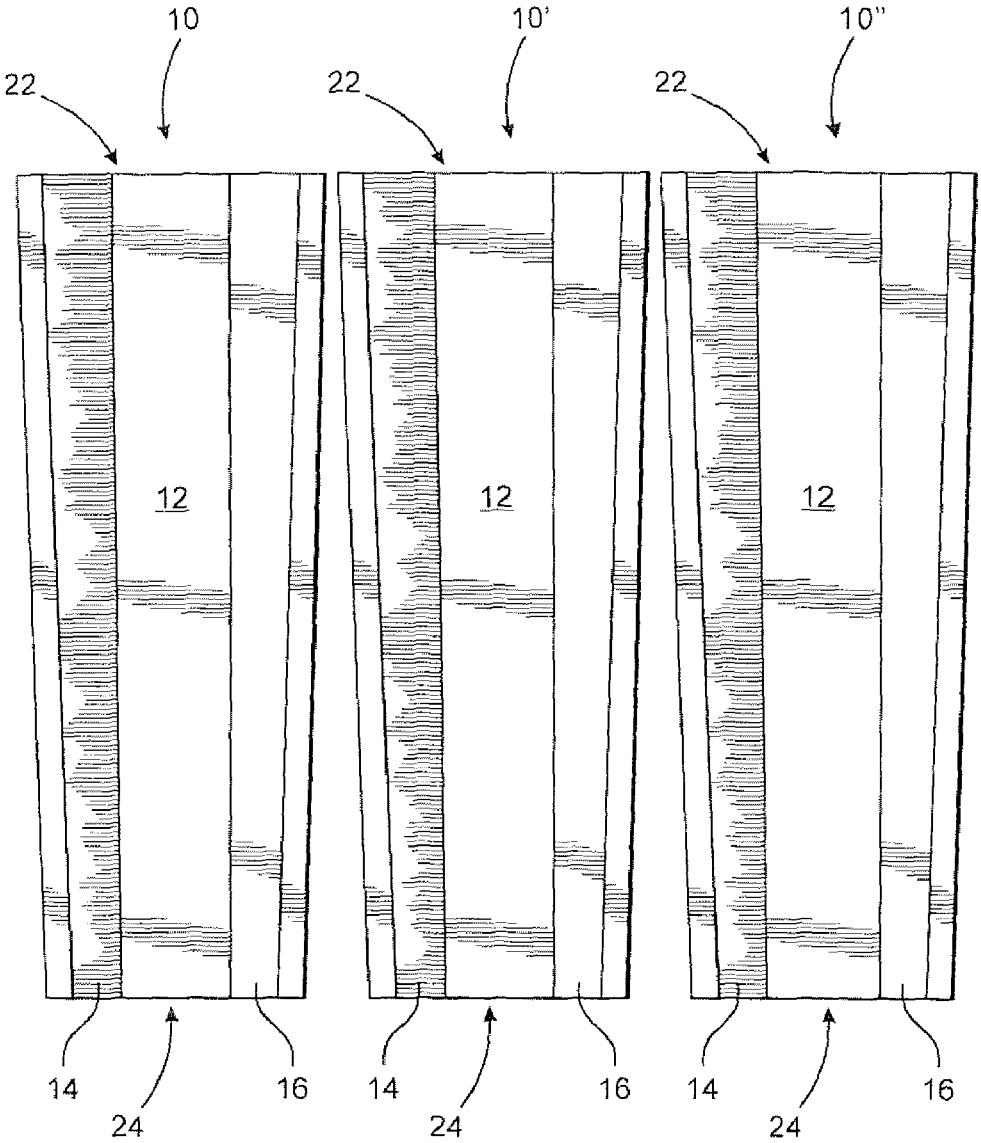
FIG. 6 is a top view of a plurality of pan tiles of the present invention disposed in a predetermined orientation, as practically applied when used in a roofing system.

Additional structural features of each of the pan tiles 10 include the side segments 14 and 16 collectively comprising a substantially converging configuration, as the side segments 14 and 16 of each pan tile 10 extend from the leading end 22 to and towards the trailing end 24 and preferably along the entire length of the base 12. Accordingly, the leading end 22 of each of the pan tiles 10 comprises a greater height dimension than that of the trailing end 24. Such a variance in height from the leading end 22 to the trailing end 24 is preferably accomplished by a progressively decreasing transverse dimension or height of the side segments 14 and 16 as they extend continuously from the leading end 22 to the trailing end 24, as represented in FIG. 5. Such a variance in the height or transverse dimension of the side segments 14 and 16 is also demonstrated in the opposite end views of FIGS. 3 and 4. Other structural and operative features of at least some of the plurality of pan tiles 10 include the base 12 having a substantially planar configuration being further defined by a substantially flat or planar undersurface, as at 12'. As such, the flat or planar undersurface 12' of each of the pan tiles 10 are disposed in confronting relation to a roof deck or like underlying support structure 20 of the roof. Such confronting engagement or relation is intended to describe and take into consideration the presence of adhering foam, cement or other appropriate securing composition or structure which may be disposed between the pan tiles 10 and the outer surface of the underlying support structure 20. Moreover such a confronting engagement or relation of each of the pan tiles 10 with the underlying support 20 facilitates a stable mounting and/or securing of each of the pan tiles 10. In accordance with the roofing system of the present invention, the plurality of pan tiles 10 are disposed in laterally adjacent relation to one another, as represented in FIG. 6.

Figure 4A:
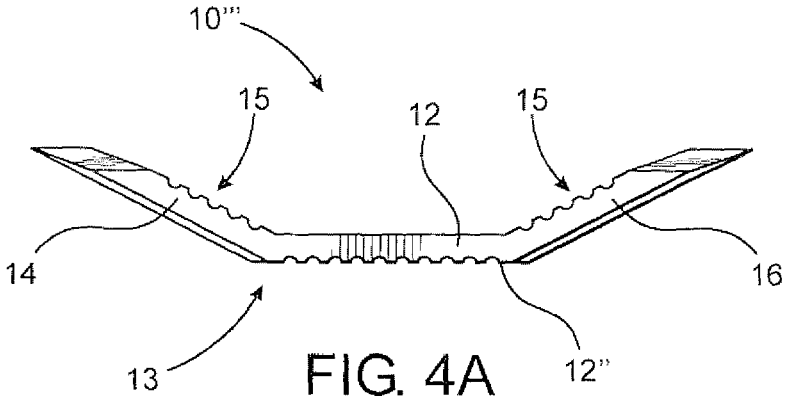
FIG. 4A is an end view in perspective of another preferred embodiment of the pan tile of the present invention similar to but distinguishable from the preferred embodiment of FIGS. 1 and 3.

However, yet another preferred embodiment of the pan tile 10''' of the present invention is represented in FIG. 4A. This embodiment includes a predetermined surface treatment, structurally characterized by a grooved undersurface, generally indicated as 12", of the base 12. As such, the undersurface comprises a plurality of grooves generally and collectively indicated as 13. The grooves 13 are disposed in at least minimally spaced relation to one another and extend along at least a portion of the length of the undersurface 12". Also, one or more of the grooves may extend along a majority of the length or along substantially the entire length of the undersurface 12" of the base 12. The grooves 13 may vary in number, size and overall configuration and may or may not be disposed in a uniform array on the undersurface 12". One purpose of the grooves 13, which in turn may be at least partially determinative of their number, size, configuration, etc, is the ability to facilitate the adherence of the base 12 to the exposed roof deck or underlying supporting structure 20. Moreover, the existence of the grooves 13 may provide a more secure interconnection or gripping engagement with a foam, cement or other type adhering material which may be disposed between the undersurface 12''' and the exposed exterior surface of the underlying supporting roof structure 20.

As also represented in FIG. 4A the aforementioned surface treatment may be applied to the interior surfaces of the side segments 14 and 16 by including a plurality of elongated, spaced apart grooves generally indicated as 15. As with the plurality of grooves 13, the grooves 15 may vary in number, size, configuration, length, etc. In at least one preferred embodiment represented in FIG. 4A, one or more of the plurality of grooves 15 extend along at least the majority or along substantially the entire length of the inner surface of the side segments 14 and 16. Also, similar to the structure and function of the plurality of grooves 13, the plurality of grooves 15 are provided to better facilitate the securement or connection between a binding or adhering material and the overlying roof tiles 18, wherein the binding, material is generally disposed into and along a length of the space 19 (see FIG. 7) so as to securely fasten or adhere the overlapping roof tiles 18 to the correspondingly positioned side segments 14 and 16 and/or the base 12 of adjacently positioned ones of the pan tiles 18.

Figure 3:
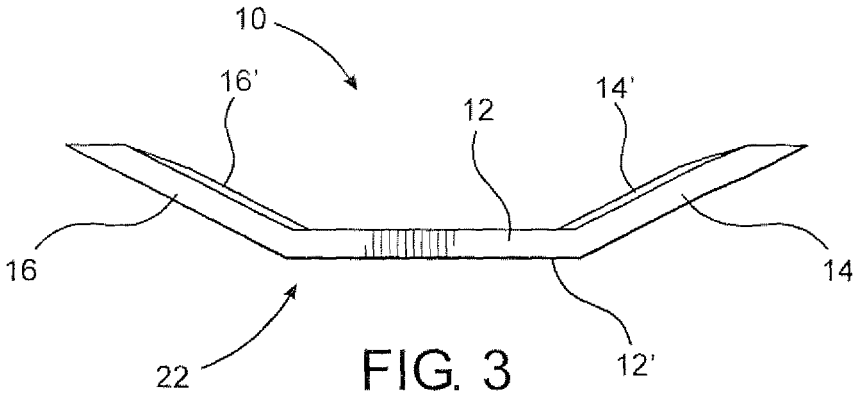
FIG. 3 is an end view of the embodiment of FIG. 1.

It should be further noted that a variation of the preferred embodiment of FIG. 4A may include the plurality of grooves 13 and the plurality of grooves 15, respectively disposed in the undersurface 12" of the base 12 and the inner surfaces of the side segments 13 and 16, being used either independently of one another or in combination with one another. More specifically, there may be practical applications where it is desirable to use the plurality of elongated grooves 13 formed in the undersurface 12" of the base 12, while the plurality of grooves 15 formed in the side segments may not be necessary. Alternatively, there may be additional practical applications wherein the plurality of grooves 15 formed in the inner surfaces of the side segments 14 and 16 are included in the pan tile 10''' and the undersurface of the base 12 is absent the grooves 13 and comprises a flat, planar surface 12', as indicated in FIGS. 3 and 4.

Figure 2:
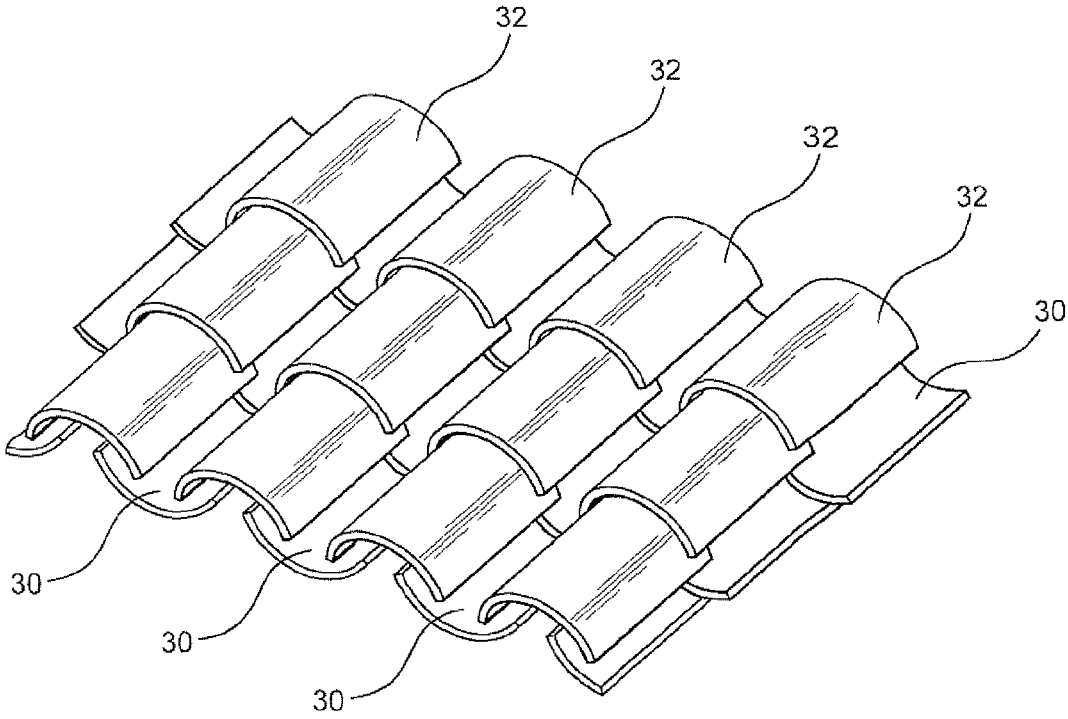
FIG. 2 PRIOR ART
FIG. 2 is a perspective view of a prior art roofing system.

Yet additional structural features of a most preferred embodiment of the present invention comprises each or at least the majority of the pan tiles 10 having a leading end generally indicated as 22 and a trailing end generally indicated as 24. For purposes of clarity the leading end 22 of each of the plurality of pan tiles 10 is disposed substantially "above" the trailing end 24, such as when the plurality of pan tiles 10 are incorporated within a roofing system secured to a sloped or slanted underlying roofing support 20, as is common. Also common to the overall array of both pan tiles and exterior roof tiles is their overlapping orientation or arrangement to longitudinally adjacent tiles, as generally indicated in FIG. 2. As represented in this prior art representation of conventional curved or barrel shaped tiles 30, longitudinally adjacent tiles are disposed in underlying relation to exterior, overlapping roof tiles 32. As such, longitudinally adjacent ones of the pan tiles 30 are disposed in overlapping relation to one another and are disposed beneath or in an underlying relation to overlapping ones of longitudinally adjacent roof tiles 32.

With further regard to the prior art representation of FIG. 2, and as generally set forth above, the use of barrel shaped pan tiles 30 in underlying, supporting engagement to exteriorly exposed roof tiles 32 results in a greater expense in the installation or use in that both the pan tiles 30 and the exposed roof tiles 32 may be hand made or customized and are typically formed from the same ceramic material. Further, the utilization of the curved or barrel shaped pan tile 30 requires a greater number of both the pan tiles 30 and roof tiles 32, which in turn results in a greater material cost as well as an increased labor cost when installing and/or repairing a conventional or prior art roofing system of the type demonstrated in FIG. 2.

Figure 7:
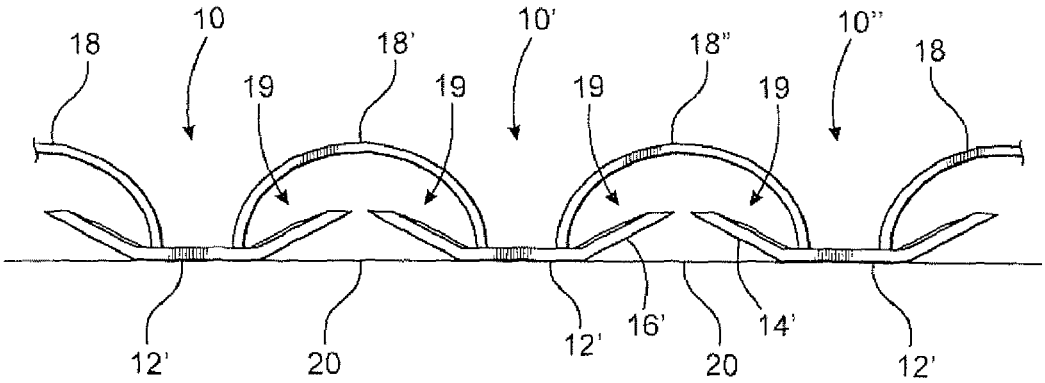
FIG. 7 is an end view of the embodiment of FIG. 6 with a plurality of roof tiles supported on the array of pan tiles.

Also, common terminology used in describing both the conventional roofing system of FIG. 2 and the improved, roofing system incorporating the pan tiles 10 of the present invention both may include the term "longitudinally adjacent" and "laterally adjacent". Accordingly, longitudinally adjacent tiles are those that are arranged in rows or columns extending from a ridge crest of the roof downwardly, wherein laterally adjacent tiles are those that are arranged in adjacent, side-by-side relation to one another. Accordingly, FIGS. 6 and 7 represent a roofing system wherein laterally adjacent tiles 10, 10', and 10" are disposed in side-by-side relation to one another and further wherein laterally adjacent roof tiles 18, 18', 18", etc. are disposed in laterally adjacent but spaced apart relation to one another.

Therefore, additional structuring of the pan tiles 10 which may be incorporated into a roofing system similar to but structurally and operatively distinguishable from the conventional roofing system of FIG. 2, accomplishes the relative overlapping relation between longitudinally adjacent ones of the pan tiles 10 and roof tiles 18 by forming the pan tiles 10 such that the leading end 22 thereof has a greater transverse dimension or width then that of the trailing end 24. Accordingly, the spacing between laterally adjacent pan tiles 10, 10', 10", etc., is represented in FIG. 6. As such, the leading ends 22 have a greater transverse dimension or width and are disposed immediately adjacent and/or in confronting relation to one another. In addition, the trailing ends 24 are orientated at a greater spaced distance from one another than are the leading ends 22. However, as practically applied to the roofing system schematically represented in FIGS. 6 and 7, laterally adjacent pan tiles 10 such as at 10' and 10" are disposed to engage and at least partially support a common roof tile 18". Such engaging support of the roof tile 18" is accomplished by laterally adjacent ones of the pan tiles as at 10' and 10" having correspondingly disposed side segments 16' and 14' being oriented in underlying relation and at least partially on the interior of the commonly supported roof tile 18".

The relative positions and/or orientations of the pan tiles 10, 10', 10'", etc. is such that a greater spacing will be created between the laterally adjacent roof tiles 18, 18', 18", etc. due to the overall structure of each of the respective pan tiles 10, 10', 10", having a flat or planar configuration of the respective bases 12. Also additional stability is provided by the confronting relation or engagement of the flat undersurface 12' or the grooved undersurface 12" with the exposed surface portion of the underlying roofing support structure 20. As such, the entire exposed outer surface area of the underlying support 20 will be adequately and appropriately covered by the roofing system as demonstrated in FIG. 7. Also, a significantly lesser amount of cementitious or other type adhering material such as polyurethane, foam, cement, etc. may be utilized to secure the pan tiles 10 or 10'" to the underlying support 20, when such securing or adhering material is utilized. Clearly, other installation techniques and processes may be used to secure the pan tiles 10 to the underlying support 20, as well as secure the roof tiles 18 to the pan tiles 10 to the underlying support 20 and one another.

Yet another preferred embodiment of the present invention is represented in FIGS. 8 through 12 and comprises one or more of a plurality of pan tiles 110 each of which have most of the physical and operative characteristics of the additional preferred embodiments of the present invention as described in FIGS. 1 through 7. More specifically, and with primary reference to FIG. 8, at least the majority of the pan tiles 110 comprise a base 112 having an elongated configuration and being integrally secured to two side segments 114 and 116. Each of the side segments 114 and 116 preferably extend along the entire length of the base 112 and are directed outwardly from opposite peripheral sides or edges, as at 114' and 116', of the base 112 in a predetermined angular orientation. Such an angular orientation is preferably a substantially common, obtuse angle which is determined to facilitate cooperative positioning and support of spaced apart, laterally adjacent roof tiles 18 as described above with reference to FIG. 7 and as additionally represented in FIG. 10.

Figure 8:
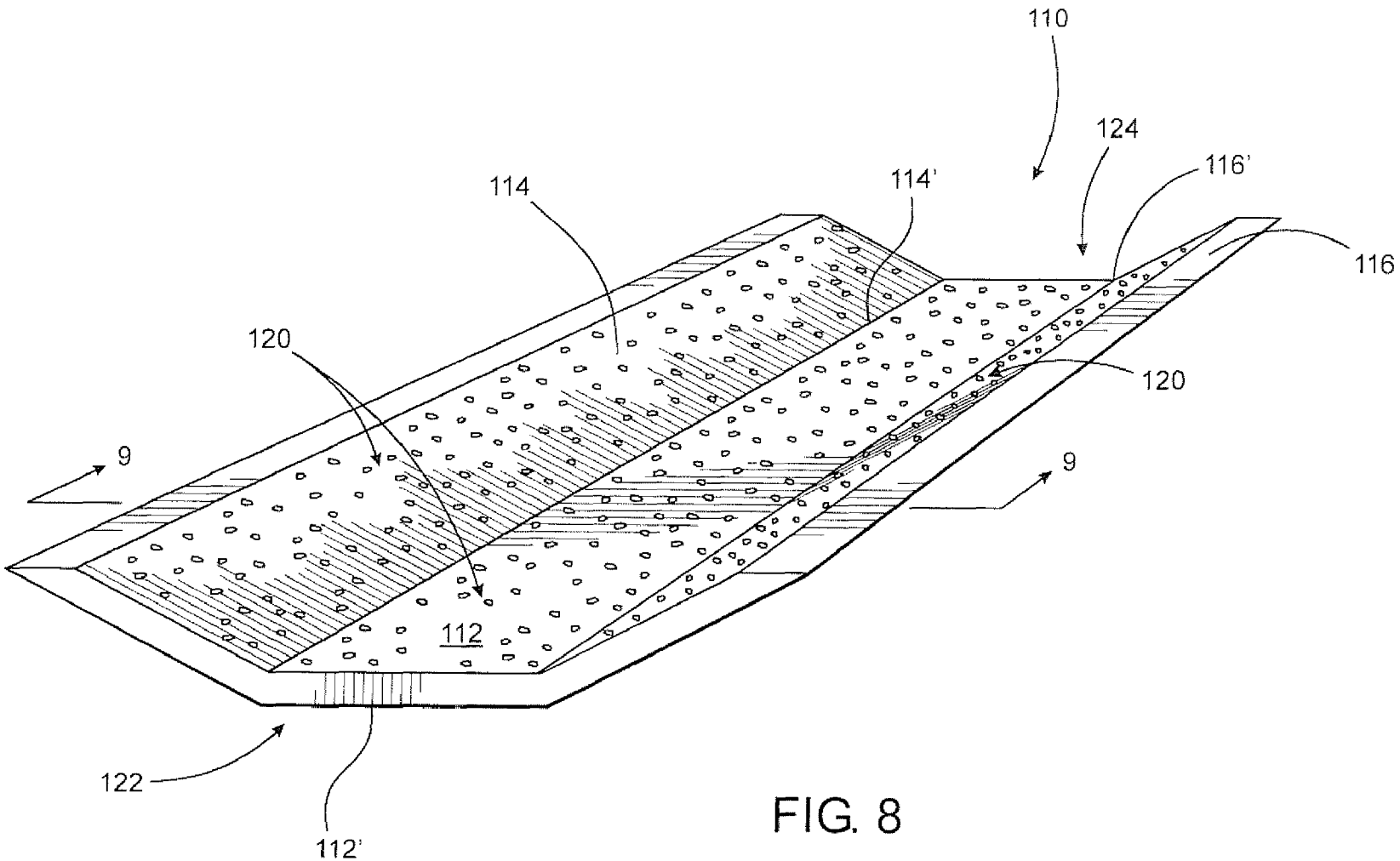
FIG. 8 is a perspective view of an additional preferred embodiment of the pan tile of the present invention.

Similar to the preferred embodiment of FIG. 1, each or at least a majority of the pan tiles 110 include the side segments 114 and 116 collectively comprising a substantially converging configuration, as represented in FIG. 8. Such a converging configuration comprises the side segments 114 and 116 extending from a leading end 122 towards a trailing end 124, of each pan tile 110. In addition, the leading end 122 of each or at least the majority of the plurality of pan tiles 110 includes a greater height dimension than that of the trailing end 124. Such a variance in height between the leading and trailing ends 122 and 124 respectively is accomplished by a progressively decreasing transverse dimension or height of the side segment 114 and 116 as they extend continuously from the leading end 122 to the trailing end 124.

Yet additional structural and operative features of the pan tiles represented in the preferred embodiment of FIG. 8 includes the base 112 having a substantially planar configuration including what may be considered a generally planar under surface, as at 112'. The substantially planar under surface 112' of the pan tiles 110 facilitate the establishment of a confronting relation between each of the pan tiles and an underlying support structure 20 of the roof are on which pan tiles are positioned. Such a "confronting" engagement or relation is intended to describe and take into consideration the presence of a foam, cement or other appropriate securing composition or structure, as at 21, which may be disposed between the under surface 112' of the base 112 and the outer surface of the underlying support structure 20 as clearly represented in FIG. 10. As will be described in greater detail hereinafter, each or at least some of the pan tiles 110 may include predetermined treated surface configuration or structure which facilitates adherence or securement of each of the pan tiles 110 to the underlying support structure 20 and the securing composition 21, as set forth above.

Figure 11:
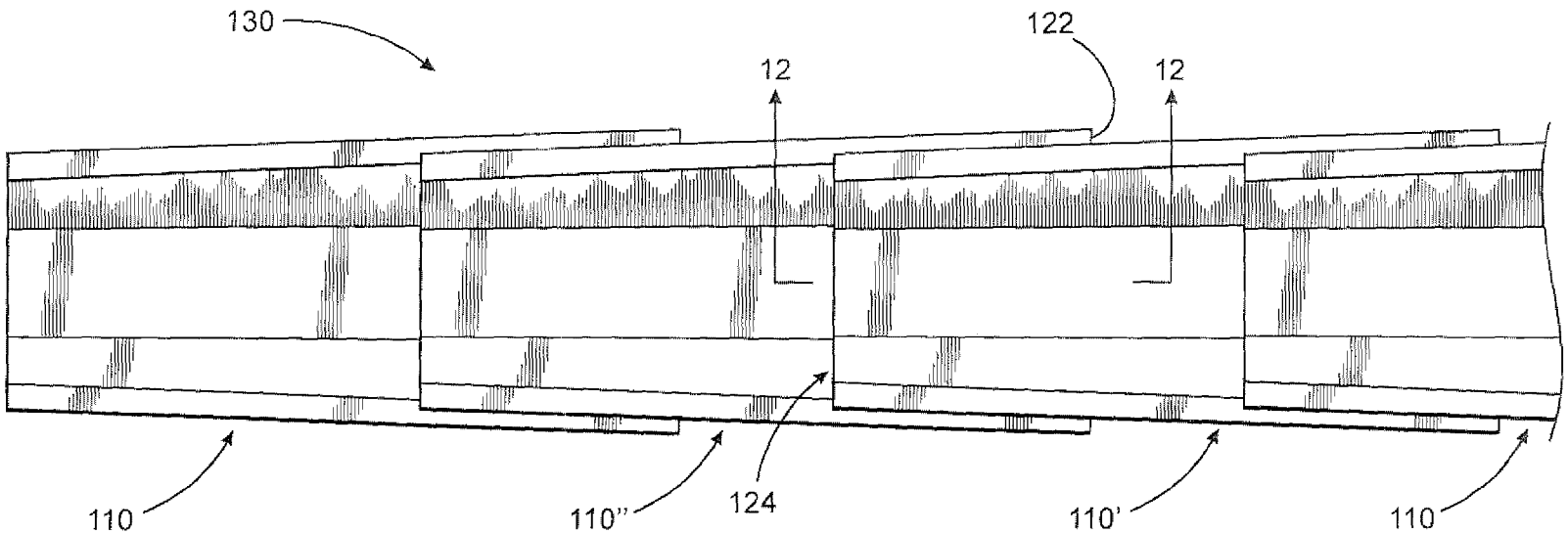
FIG. 11 is a top view of yet another preferred embodiment of the present invention comprising a plurality of the pan tiles of the embodiment of either FIG. 1 or 8 fixedly connected to one another to define a longitudinal array.
Figure 12:
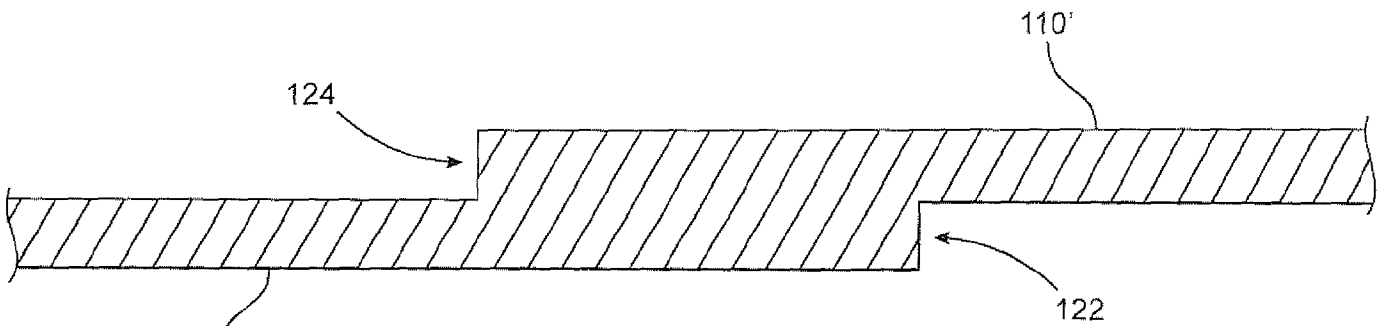
FIG. 12 is a section view in partial cutaway along line 12-12 of FIG. 11.

With primary reference to FIGS. 8, 11 and 12, a structural variation comprising yet another preferred embodiment of the present invention includes each or at least some of the pan tiles 110 formed from a "plastic" material. As used herein the plastic should have performance characteristics which allow the pan tile 10 to be formed using conventional or customized molding procedures, which may be available in the industry. In a most preferred embodiment of the present invention, the plastic material from which a plurality of the pan tiles 110 are formed comprises a fiber reinforce polymer and even more specifically, a glass-reinforce plastic commonly referred to as "fiberglass". When fiberglass or other appropriate plastic materials are utilized in the formation of the plurality of pan tiles 110, additional benefits are provided in the form of strength, flexibility, ultraviolet (UV) protection as well as a variety of other beneficial performance characteristics.

Figure 10:
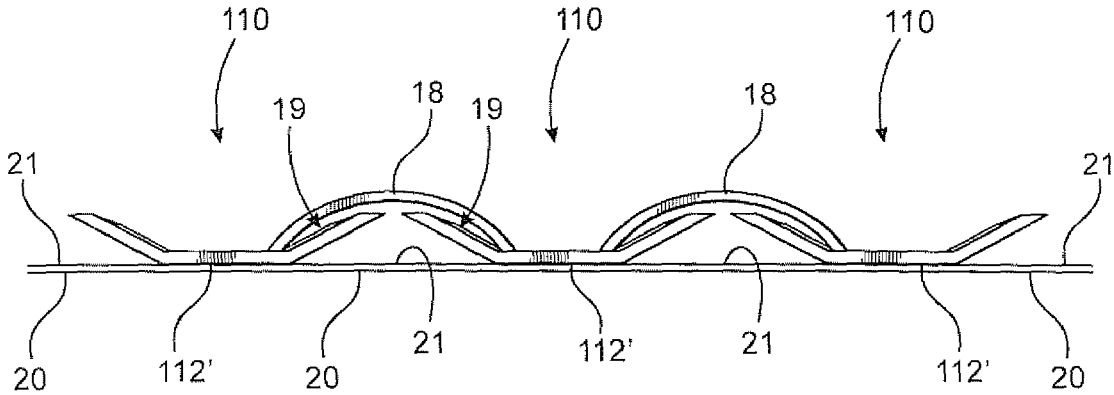
FIG. 10 is an end view similar to the embodiment of FIG. 7 but incorporating the structural and operative features of the additional preferred embodiment of FIG. 8.

By way of example, when applied in the manner schematically represented in FIG. 10 the plurality of pan tiles 110 are disposed in underlying and at least partially supporting relation to the outer exposed roof tiles 118. The inherent flexibility associated with the fiberglass or other plastic material allows a certain degree of "shock absorbency", such as when individuals walk on the roof structure and/or other force or pressure is applied thereto. As conventionally recognized, if the exposed roof tiles 18 as well as the pan tiles 110 were formed from a clay, ceramic or other conventional material, breakage frequently occurs when a sufficient force or pressure is applied either to the exterior of the exposed roof tiles 18 or directly to the pan tiles 110 themselves. However, the forming of the pan tiles 110 from an appropriate and sufficiently flexible, plastic material, such as fiberglass, reduces such breakage.

As set forth above, the various embodiments of the present invention including individual pan tiles 110 or a linear, longitudinal array 130 of fixedly interconnected ones of such pan tiles can be formed from a variety of materials including ceramic material, fiber glass, other moldable plastic or resin materials and/or an organic based material which may be used independently of or in combination with a resin. Accordingly, in at least one preferred embodiment the materials from which the pan tiles 10, 110 and/or longitudinal array 130 of such pan tiles may be formed should be moldable so as to facilitate the manufacture and production thereof. Further, when fiber glass, organic based and/or organic/resin materials are utilized, sufficient strength is provided to the formed pan tiles while having the additional advantage of significantly reduced weight, which in turn reduces the overall cost factor at least in terms of transportation, installation, etc.

Moreover, and with primary reference to FIGS. 11 and 12, the moldable characteristics of the fiberglass or other plastic material from which the plurality of pan tiles 110 are formed facilitate a fixed interconnection of longitudinally adjacent pan tiles, generally represented as 130 in FIG. 11. This facilitates the formation of a longitudinal or elongated array of fixedly interconnected, overlapping pan tiles 110. Such fixed interconnection may in fact be an integral formation as represented in FIG. 12, wherein the elongated or longitudinal array 130 of FIG. 11 is more specifically defined by corresponding ends of longitudinal adjacent pan tiles 110 being integrally connected in overlapping relation to one another.

The overlapping configuration of the longitudinal array 130 may be more specifically defined by a trailing end 124 of tiles 110' being disposed in overlying relation with a next successive, longitudinally adjacent tile 110". Therefore, the fixed interconnection between the longitudinally adjacent pan tiles 110, etc. may be accomplished by an integral bonding. As such, the plurality of pan tiles 110 defining the overlapping, longitudinal array, as represented in FIG. 11, may be further defined by a unitary, one piece construction comprising the plurality of fixed or integrally interconnected pan tiles. Clearly, the number of pan tiles may vary from two overlapping pan tiles to a much greater number of pan tiles depending upon the specific application for which the pan tiles are utilized and/or various factors associated with the manufacture and/or formation thereof.

Figure 9:
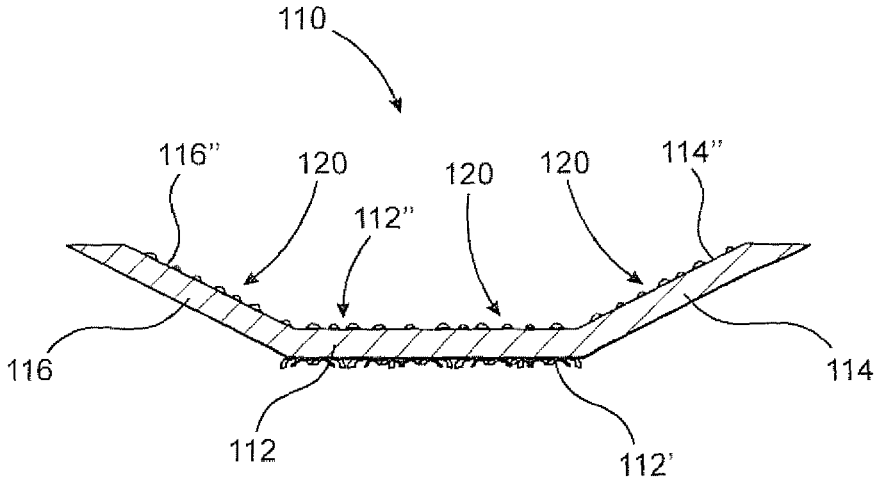
FIG. 9 is a sectional view taken along lines 9-9 of FIG. 8.

With primary reference to FIGS. 8 through 10, yet additional structural and operative features associated with the additional preferred embodiment of the pan tiles 110 includes a predetermined surface treatment thereof. More specifically, as represented in FIGS. 8 and 9 one preferred surface treatment includes the undersurface 112' of the base 112 comprising an irregular surface configuration more specifically defined by a roughened and/or unfinished under surface 112'. Such a roughened or unfinished surface may be further defined by the fiber particles of the fiberglass material from which the pan tiles 110 are formed being exposed rather than being subjected to a smoothing, finishing process. As such, the exposed fiber particles, which may include the reinforcing glass fibers, will further facilitate adherence to the confronting relation and/or engagement of each of the pan tiles 110 with the underlying support structure 20 of the roof on which the plurality of pan tiles 110 are positioned, as schematically represented in FIG. 10. As also set forth above, the confronting relation or engagement of the pan tile 110 is meant to take into consideration the existence or presence of adherence or securing composition 21 in the form foam (poly-foam), cement or any other securing or adhering material which serves to facilitate secure, confronting relation of the plurality of pan tiles 110 to the underlying support structure 20. Therefore, the roughened, irregular or unfinished surface configuration of the undersurface 112' will facilitate such a stable securement to the underlying support structure 20 conventionally, but not necessarily in the presence of the securing or adhering composition 21.

Again with primary reference to FIGS. 8 through 10, an additional variation of the predetermined surface configuration may also be applied to the inner surface 112" of the base 112, as represented in FIG. 9 and/or each or at least one of the inner surfaces 114" and 116" of the side segment 114 and 116. More specifically, the predetermined surface treatment of the base 112 may also include the provision of a particulate material on the inner surface 112" such that the particulate material 120 protrudes at least partially outwardly from the treated inner surface 112" thereby also providing an irregular surface configuration. The particulate material 20 may vary in consistency and composition and as such may comprise sand, gravel, rock particles or particulate material of a variety of different compositions. Further, the individual particle size may vary from a substantially granular consistency to much larger particles, such as rock, stone or other material particles. Similarly, as represented in both FIGS. 8 and 9 at least one of the inner surfaces 114" and/or 116" or both of such inner surfaces of the respective side segments 114 and 116 may also include this predetermined surface treatment comprising the adding of the particulate material 120 to the inner surfaces thereof. Therefore, the various preferred embodiments of the present invention may include predetermined surface treatments to the inner surface 112" of the base 112 in combination with or independent of each of the inner surfaces 114" and 116".

Further, the adding or provision of the particulate material 120 may be accomplished during the molding process of the fiber glass or other appropriate organic or combined organic/plastic materials from which the plurality of pan tiles 110 are formed. In doing so, the particulate material 120 will be integrally formed in the pan tiles 110 so as to extend at least partially outwardly from the specifically indicated surfaces 112" and/or 114" and/or 116". As such, the application of the particulate material 120 to one or more inner surfaces 112", 114" and 116" has the benefit further facilitating the securement or adherence of the roof tiles 18 to the various inner surfaces of the supporting pan tiles 110 as represented in FIG.

10. This adherence may be further enhanced by the inclusion of the aforementioned adhering or securing composition being placed than the spaces 19 or on various other portions of the inner surfaces 112", 114" and/or 116".

Figure 13:
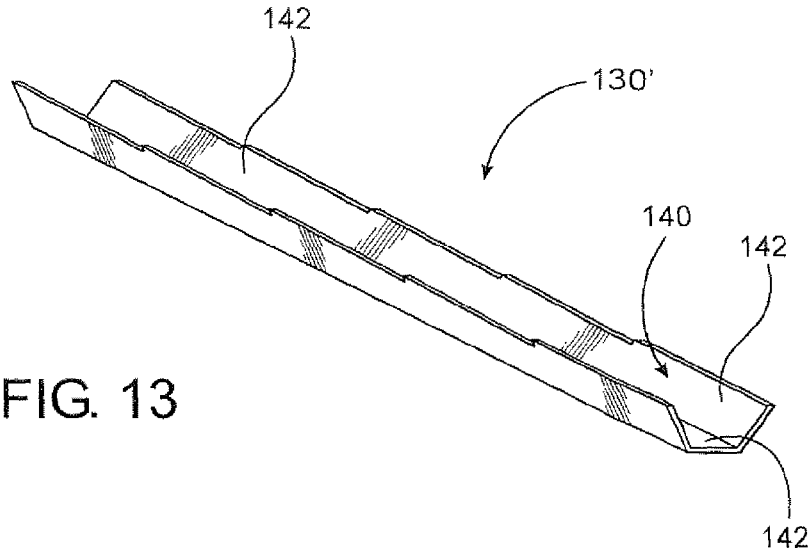
FIG. 13 is a perspective view of yet another preferred embodiment of the present invention similar to the embodiment of FIGS. 11 and 12 and comprising a plurality of pan tiles molded into or otherwise fixedly or integrally connected to one another to define a longitudinal array and including a solar energy system.
Figure 14:
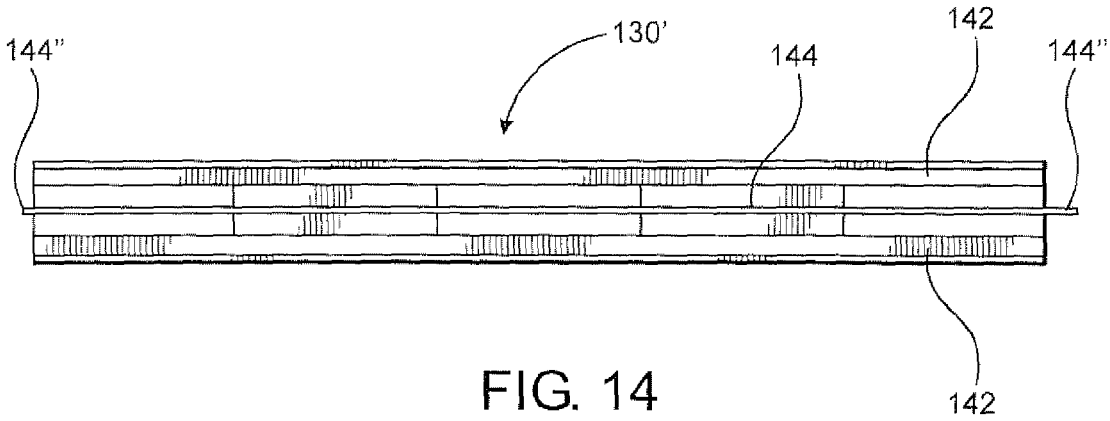
FIG. 14 is a top interior view of the embodiment of FIG. 13.
Figure 15:
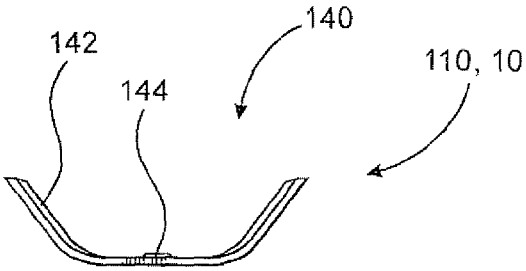
FIG. 15 is a cross sectional view of yet another preferred embodiment of the present invention which further represents the inclusion of a solar energy system incorporated with the pan tile of any one or all of the preferred embodiments of FIGS. 1, 8, 11 and/or 13.

In yet another preferred embodiment, such as that represented in FIGS. 13 through 15, a longitudinal array 130' of pan tiles may be especially conducive to accommodate a solar energy system 140, generally indicated as 140. More specifically, the solar energy system 140 is preferably defined by a photovoltaic system or assembly which is preferably in the form of a thin, flexible film of amorphous photovoltaic material or structure, as described above. While the photovoltaic material film 142 is schematically represented in FIGS. 13-15 it is also emphasized that the solar energy system 140 can be alternatively defined by a crystalline (mono and/or poly) photovoltaic system comprising an array of silicon wafers secured in an appropriate manner to the inner surfaces of the individual pan tiles 110, 10 and/or the longitudinal array 130', as clearly represented.

As also represented in the embodiments of FIG. 14, the solar energy system 140 may also include electrical conductors in the form of strips, panels, conduits, etc. 144, which extend longitudinally along the length of the longitudinal array of fixedly or integrally secured panels 130'. This longitudinal and/or "vertical" orientation of the conductor 144, when the longitudinal arrays 130 are operatively disposed on a pitched roof, have additional advantages in terms of installation and differs from known or conventional solar panel installation assemblies. Moreover, conventional solar panels or like solar energy systems typically include transversely oriented conductors to facilitate an electrical and/or operative interconnection of the photovoltaic structures 142. Further, the schematic representation of FIG. 14, while not showing a specific interconnection of adjacently or cooperatively positioned longitudinal arrays 130' is meant to be indicative of the opposite ends of the electrical conductor 144, as at 144' and 144", being disposed for operative interconnection with additional and/or adjacent conductors associated with next adjacent or otherwise cooperatively positioned longitudinal arrays 130'. In this manner, continuity over an extended length can be achieved in an aesthetic and easy to implement fashion. Moreover, the solar energy system 140 will achieve a greater integrity, as it will not be subject to possible points of weakness or separation between each and every pan tile.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A pan tile for use in a roofing assembly which includes a plurality of exposed roof tiles, said pan tile comprising:

a base and two oppositely disposed side segments extending continuously along a length of said base from a leading end to a trailing end of said pan tile, said base and said side segments integrally formed with one another from a moldable material, said base having a planar configuration and a substantially uniform transverse dimension along its length, said base disposed in confronting relation with an underlying support, each of said side segments having a planar configuration extending outwardly from said base at a substantially common, obtuse angle, each of said side segments including a greater transverse dimension at said leading end than said trailing end, each of said side segment further including a continuously decreasing transverse dimension and a collectively converging configuration from said leading end to said trailing end to define said leading end having a greater transverse dimension and height than said trailing end, and said base and said side segments structured to be disposed in underlying relation to at least one of the plurality of exposed roof tiles.

2. A pan tile as recited in claim 1 wherein said moldable material comprises a plastic material, said plastic material comprising a glass fiber reinforced polymer incorporated therein.

3. A pan tile as recited in claim 2 wherein said plastic material further comprises an organic material incorporated as at least a part thereof.

4. A pan tile as recited in claim 1 wherein each of said side segments extends outwardly from and along the length of said base at an obtuse angle relative to said base.

5. A pan tile as recited in claim 1 wherein said base and said sides segments are formed of a fiberglass material; said base comprising a roughened irregular undersurface.

6. A pan tile as recited in claim 5 wherein said roughened irregular undersurface is structured to facilitate adherence to the underlying support.

7. A pan tile as recited in claim 5 wherein said base comprises an inner surface having a predetermined surface treatment at least partially defined by an irregular surface configuration.

8. A pan tile as recited in claim 7 wherein said predetermined surface treatment is structured to facilitate adherence of a roof tile thereto.

9. A pan tile as recited in claim 7 wherein said irregular surface configuration is at least partially defined by a particulate material secured to said base and at least partially extending outwardly from said inner surface thereof.

10. A pan tile as recited in claim 9 wherein said particulate material at least partially comprises a substantially granular consistency.

11. A pan tile as recited in claim 9 wherein at least one of said side segments includes an inner surface comprising said irregular surface configuration being defined by a particulate material secured thereto and at least partially extending outwardly therefrom.

12. A pan tile as recited in claim 11 wherein each of said side segments includes an inner surface comprising said irregular surface configuration being defined by a particulate material secured thereto and at least partially extending outwardly therefrom.

13. A pan tile as recited in claim 12 wherein said particulate material at least partially comprises a substantially granular consistency.

14. A pan tile as recited in claim 12 wherein said particulate material comprises a decorative appearance.

15. A pan tile as recited in claim 1 further comprising a solar energy system disposed on predetermined portions of the pan tile.

16. A pan tile as recited in claim 15 wherein said solar power generating system comprises a photovoltaic assembly disposed on an exposed surface of said base and said side segments.

17. A pan tile as recited in claim 16 wherein said photovoltaic assembly comprises an amorphous silicon film disposed in an interior exposed location on exposed surfaces of said base and said side segments.

18. A roofing system comprising:

a plurality of pan tiles each including a leading end and a trailing end, said plurality of pan tiles collectively disposed and structured to receive a plurality of roof tiles in overlying relation to said pan tiles, each of said pan tiles including a base having a planar configuration and a uniform transverse dimension along its length and two side segments, each side segment extending along an opposite longitudinal periphery of an entire length of said base and extending outwardly therefrom at common obtuse angles, each of said side segments including a greater transverse dimension at said leading end than said trailing end, each of said side segments further including a continuously decreasing transverse dimension and a collectively converging configuration from said leading end to said trailing end to define said leading end having a greater transverse dimension and height than said trailing end, said base having an under surface disposed in confronting relation to an underlying support, at least some of said plurality of pan tiles fixedly secured to one another in an elongated, overlapping array, and said overlapping array comprising said trailing end of one pan tile disposed in overlying relation to a leading end of a successive, longitudinally adjacent pan tile.

19. A roofing system as recited in claim 18 wherein said overlapping array further comprises longitudinally adjacent ones of said pan tiles being formed of a plastic material and integrally secured to one another.

20. A roofing system as recited in claim 18 wherein said overlapping array comprises an integral, one piece construction.

21. A roofing system as recited in claim 18 wherein said plastic material comprises fiberglass.

22. A roofing system as recited in claim 18 further comprising a solar energy system disposed on a predetermined portion of said overlapping array.

23. A roofing system as recited in claim 22 wherein said solar energy system comprises a photovoltaic assembly disposed on an exposed surface of said overlapping array.

24. A roofing system as recited in claim 23 wherein said photovoltaic assembly comprises an amorphous silicon film disposed in an exposed location on exposed interior surfaces of said overlapping array.

* * * * *